US007036689B1

(12) United States Patent
Laffey

(10) Patent No.: US 7,036,689 B1
(45) Date of Patent: May 2, 2006

(54) CHILD-RESISTANT TRIGGER SPRAYER

(75) Inventor: Martin S. Laffey, Sylvania, OH (US)

(73) Assignee: Continental Afa Dispensing Company, St. Peters, MO (US)

( * ) Notice: Subject to any disclaimer, the term of this patent is extended or adjusted under 35 U.S.C. 154(b) by 362 days.

(21) Appl. No.: 10/128,195

(22) Filed: Apr. 22, 2002

(51) Int. Cl.
*B67B 5/00* (2006.01)

(52) U.S. Cl. ..... 222/153.14; 222/153.13; 222/380; 222/383.1; 215/216

(58) Field of Classification Search ..... 222/153.13, 222/153.14, 153.06, 385, 321.1–321.9, 380, 222/384, 153.04, 383.1, 372; 215/216–218, 215/201, 220; 239/333
See application file for complete search history.

(56) References Cited

U.S. PATENT DOCUMENTS

| | | | | | |
|---|---|---|---|---|---|
| 4,117,945 | A | * | 10/1978 | Mumford | 215/216 |
| 4,134,513 | A | | 1/1979 | Mumford | |
| 4,204,614 | A | | 5/1980 | Reeve | |
| 4,257,561 | A | | 3/1981 | McKinney | |
| 4,346,821 | A | * | 8/1982 | Wesner et al. | 222/153.02 |
| 4,358,057 | A | * | 11/1982 | Burke | 239/333 |
| 4,441,633 | A | | 4/1984 | Bennett | |
| 4,479,593 | A | | 10/1984 | Bundschuh | |
| 4,516,695 | A | | 5/1985 | Garneau | |
| 4,989,790 | A | * | 2/1991 | Martin et al. | 239/483 |
| 5,040,702 | A | | 8/1991 | Knickerbocker | |
| 5,050,779 | A | | 9/1991 | Knickerbocker | |
| 5,088,628 | A | | 2/1992 | Knickerbocker | |
| 5,228,600 | A | | 7/1993 | Steijns | |
| 5,238,152 | A | | 8/1993 | Maas | |
| 5,368,234 | A | * | 11/1994 | Foster et al. | 239/333 |
| 5,477,989 | A | | 12/1995 | Maas | |
| 5,499,766 | A | * | 3/1996 | Foster et al. | 239/333 |
| 5,564,604 | A | | 10/1996 | Tada | |
| 5,649,646 | A | | 7/1997 | Foster | |
| 5,657,907 | A | | 8/1997 | Dobbs | |
| 5,664,732 | A | | 9/1997 | Smolen, Jr. | |
| 5,687,880 | A | | 11/1997 | Maas | |
| 5,706,983 | A | | 1/1998 | Dobbs | |
| 6,003,738 | A | | 12/1999 | Foster | |
| 6,186,366 | B1 | | 2/2001 | Good | |
| 6,227,411 | B1 | | 5/2001 | Good | |
| 6,244,469 | B1 | | 6/2001 | Knickerbocker | |

* cited by examiner

*Primary Examiner*—Frederick C. Nicolas
(74) *Attorney, Agent, or Firm*—Thompson Coburn, LLP

(57) ABSTRACT

A child-resistant trigger sprayer includes a sprayer body having a barrel with an internal passage, and at least one first lug formed integrally with the barrel and extending radially outwardly from the barrel. A nozzle is rotatable on the barrel between at least one first position for dispensing liquid from the passage, and at least one second position for blocking dispensing of liquid from the passage. The nozzle has a flexible resilient skirt that is telescopically received over the barrel and the first lug on the barrel, and at least one pair of second lugs extending radially inwardly from the skirt for circumferential abutment on opposed sides of the first lug to block rotation of the nozzle in both directions from the second position toward the first position. The skirt is deflectable to distort the portion of the skirt carrying the second lugs radially outwardly so as to be rotatable past the first lug.

21 Claims, 4 Drawing Sheets

CHILD-RESISTANT TRIGGER SPRAYER

The present invention is directed to trigger sprayers for dispensing liquids, and more particularly to provision of child-resistant structure on sprayers of this type for resisting rotation of the sprayer nozzle from the "off" position to a dispensing position of the nozzle.

BACKGROUND AND SUMMARY OF THE INVENTION

Trigger sprayers and packages of the subject type conventionally include a sprayer body with facility for mounting the body on the open end of a container. A trigger actuator is coupled to a pump mechanism within the sprayer body for manual activation by a user to draw liquid from within the container and direct the liquid along a passage in an outlet barrel on the sprayer body. A nozzle is mounted on the end of the barrel for rotation between one or more first positions for dispensing liquid from the passage in the barrel, and one or more second positions for blocking the dispensing of the liquid. U.S. Pat. No. 5,664,732, for example, discloses a trigger sprayer in which the nozzle is rotatable between diametrically opposed "off" positions and diametrically opposed dispensing positions at 90° spacing from the "off" positions. The nozzle is adapted to dispense liquid in the form of a spray or a stream depending upon the selected dispensing position of the nozzle.

A general object of the present invention is to provide a trigger sprayer and package of the type described above that is constructed in such a way as to resist rotation of the nozzle from the "off" position, and to require simultaneous application of forces in more than one direction to rotate the nozzle from the "off" position to a dispensing position.

A child-resistant trigger sprayer in accordance with a first aspect of the present invention includes a sprayer body having a barrel with an internal passage, and at least one first lug formed integrally with the barrel and extending radially outwardly from the barrel. A nozzle is rotatable on the barrel between at least one first position for dispensing liquid from the passage, and at least one second position for blocking the dispensing of liquid from the passage. The nozzle has a flexible resilient skirt that is telescopically received over the barrel and the first lug on the barrel, and at least one pair of second lugs extending radially inwardly from the skirt for circumferential abutment on opposed sides of the first lug to block rotation of the nozzle in both directions from the second position toward the first position. The skirt is deflectable to distort the portion of the skirt carrying the second lugs radially outwardly so as to be rotatable past the first lug.

A child-resistant trigger sprayer in accordance with a second aspect of the invention includes a sprayer body having a barrel with an internal passage and a pair of diametrically opposed external lugs spaced from the outlet end of the barrel. A nozzle is mounted for rotation on the barrel between first and second positions 180° spaced from each other for dispensing liquid from the passage, and third and fourth positions 180° spaced from each other and spaced 90° from the first and second positions for blocking the dispensing of liquid from the passage. The nozzle has a flexible resilient skirt telescopically received over the end of the barrel and the lugs on the barrel. The skirt has diametrically opposed spaced pairs of internal lugs for circumferential abutment on opposed sides of the lugs on the barrel to block rotation of the nozzle in both directions from the third and fourth positions toward the first and second positions. The skirt is deflectable upon application of external pressure to the skirt to distort the skirt such that the pairs of lugs on the skirt are deflected radially outwardly sufficiently to clear the lugs on the barrel and permit rotation of the nozzle in either direction from the third and fourth positions toward the first or second position. In accordance with a third aspect of the invention, a trigger sprayer in accordance with the first or second aspect of the invention is mounted on the open end of a container to form a child-resistant trigger sprayer package.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
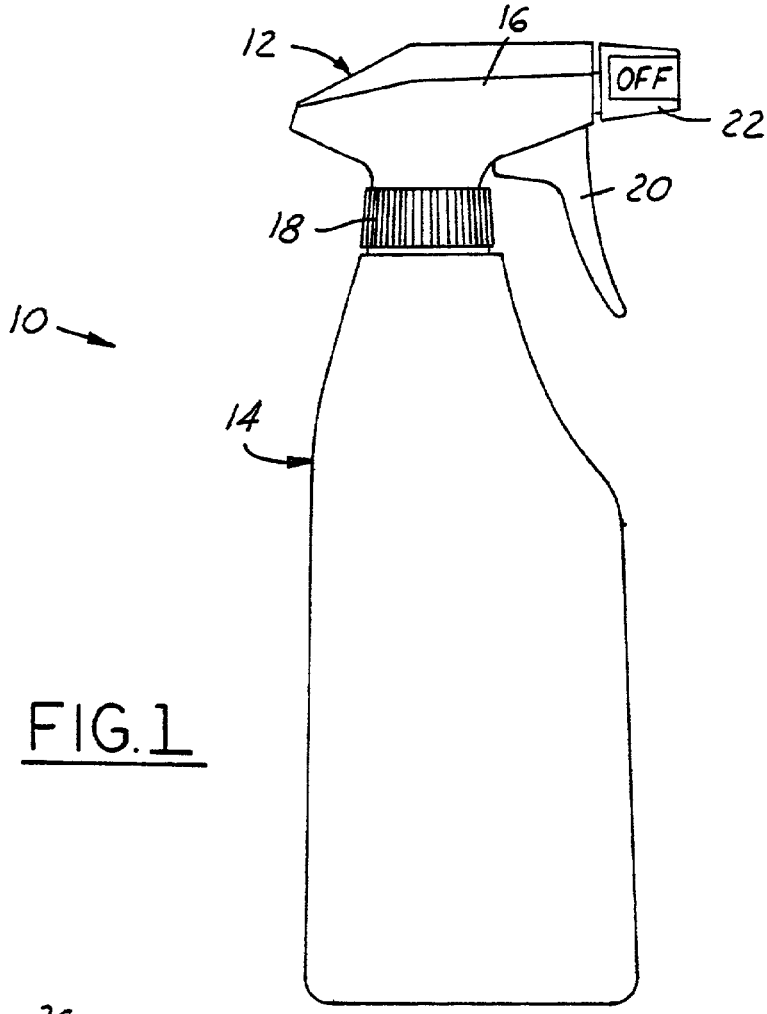
FIG. 1 is an elevational view of a child-resistant trigger sprayer liquid dispensing package in accordance with one exemplary but presently preferred embodiment of the invention.

FIG. 1 illustrates a child-resistant trigger sprayer liquid dispensing package 10 in accordance with one presently preferred embodiment of the invention as comprising a trigger sprayer 12 mounted on the open end of a container or bottle 14. Trigger sprayer 12 includes a sprayer body 16 that is secured to the open end of container 14 by a rotatable collar 18. A trigger-type actuator 20 is movably mounted on sprayer body 16, preferably pivotally mounted on the sprayer body, and is coupled to a pump mechanism within the sprayer body for dispensing liquid from the outlet end of the sprayer. A nozzle 22 is rotatably mounted on the outlet end of sprayer body 16. Nozzle 22 is rotatable between diametrically opposed "off" positions that block the dispensing of liquid from sprayer body 16, and diametrically opposed dispensing positions that permit the dispensing of liquid. Nozzle 22 preferably includes structure for dispensing liquid in differing forms, such as in the form of a spray and a stream, in the two dispensing positions of the nozzle. To the extent thus far described, the package of FIG. 1 is similar to that illustrated in above-noted U.S. Pat. No. 5,664,732, to which reference may be had for a more detailed discussion.

Figure 2:
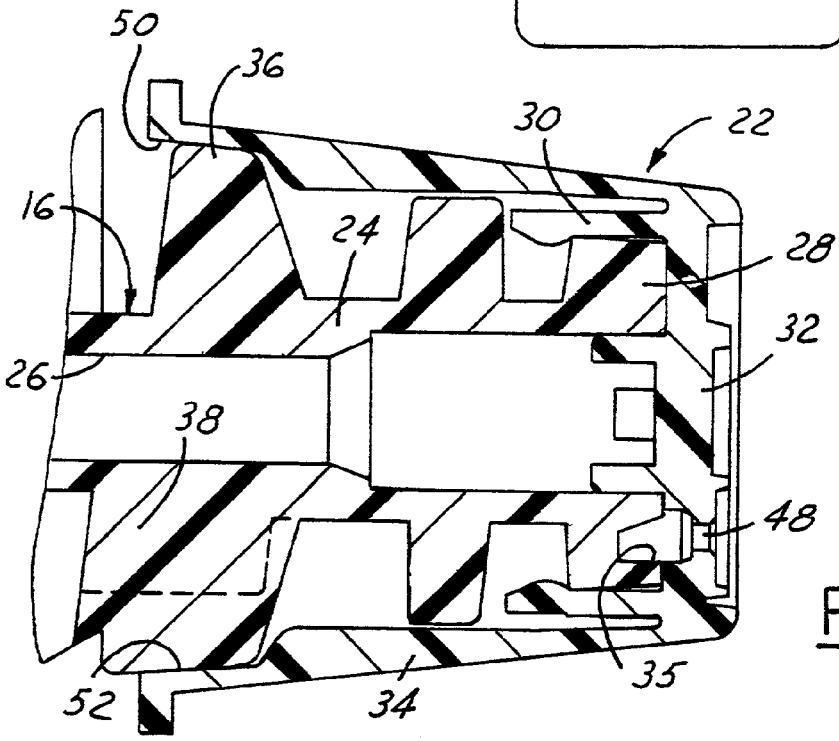
FIG. 2 is a fragmentary sectional view of the outlet end of the trigger sprayer in the package of FIG. 1.
Figure 3:
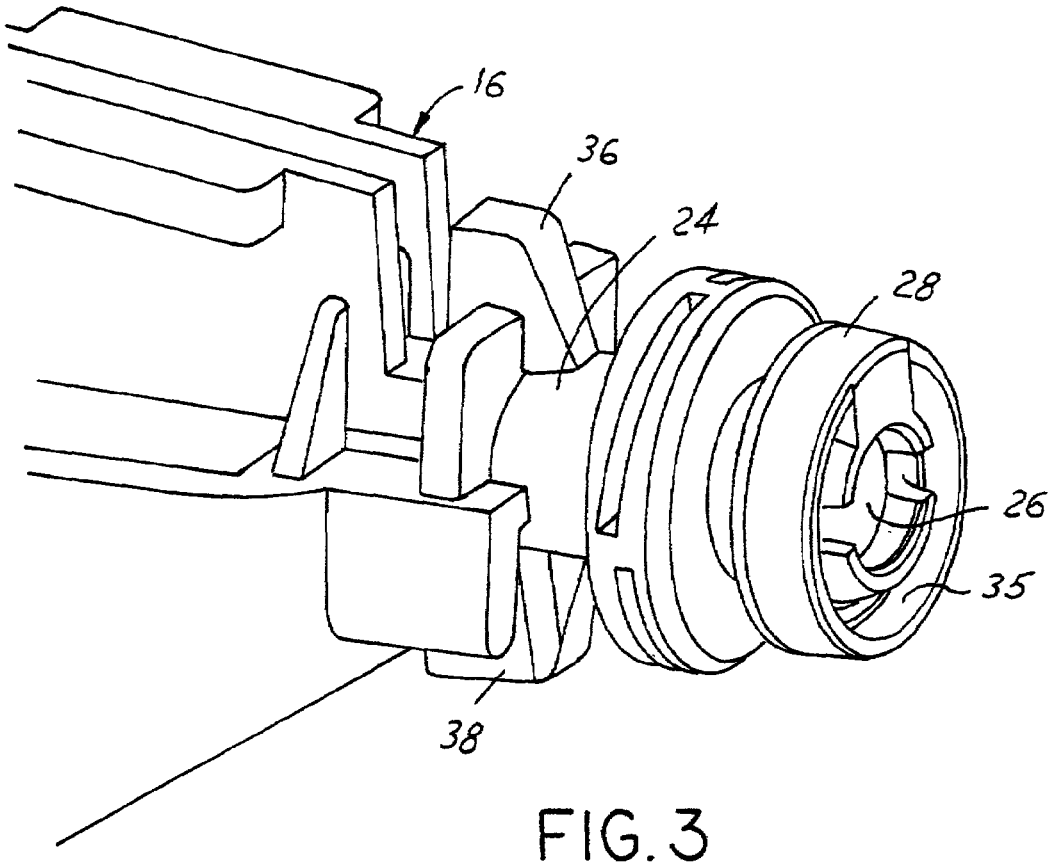
FIG. 3 is a perspective view of the outlet end of the trigger sprayer body in the package of FIGS. 1 and 2.
Figure 4:
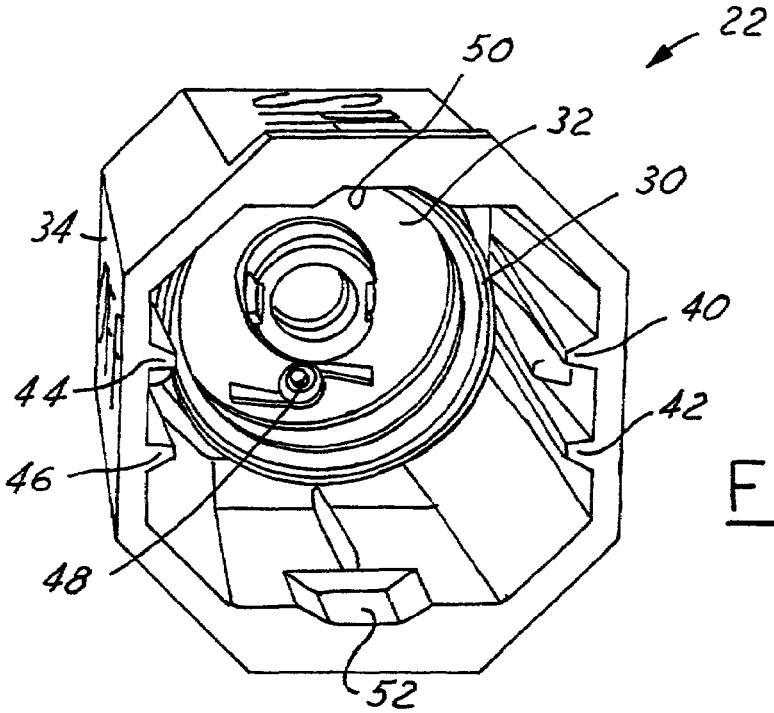
FIG. 4 is a perspective internal view of the trigger sprayer nozzle in the package of FIGS. 1–2.

FIGS. 2–3 illustrate the dispensing or outlet end of sprayer body 16 as including an elongated barrel 24 having an internal passage 26 through which liquid is dispensed from the container. Barrel 24 has a bearing collar 28 at the outlet end of the barrel. Nozzle 22 has an annular wall 30 that is externally received by snap-fit over bearing collar 28 for securing the nozzle to the barrel while permitting rotation of the nozzle with respect to the barrel. Nozzle 22 has an end wall 32 in which the dispensing opening or openings 48 are disposed, and a skirt 34 that extends from the periphery of end wall 32. Opening or openings 48 communicate with barrel passage 26 through a chamber 35 in collar 28. In the embodiment of the invention illustrated in the drawings, skirt 34 is polygonal in cross sectional geometry, having four orthogonally spaced flat walls on which suitable indicia is molded, such as OFF, SPRAY, OFF and STREAM. OFF indicia are illustrated in FIG. 1, and SPRAY and OFF indicia are partially illustrated in FIG. 4. These indicia are coordinated with the outlet opening or openings in the nozzle to indicate the configuration of the dispensing pattern (spray or stream) or that dispensing is blocked (off). The four flat walls on which the indicia are molded (or otherwise secured such as by printing or labeling) preferably are interconnected by four corner walls to lend an octagonal cross section to the nozzle as a whole.

A pair of diametrically opposed external lugs 36, 38 extend radially outwardly from the outer surface of barrel 24 at a position axially spaced from bearing collar, which is adjacent to the outlet end of the barrel. Skirt 34 of nozzle 22 is telescopically received over the end of barrel 24, including lugs 36, 38, as best seen in FIG. 2. Diametrically opposed pairs of internal lugs 40, 42 and 44, 46 extend radially inwardly from the inside surface of nozzle skirt 34. Lugs 40–46 preferably are disposed on the inside surfaces of the flat skirt wall portions on which external OFF indicia are provided. Lugs 40, 42 and 44, 46 of each pair are spaced from each other so as to be receivable in circumferential abutment on opposed sides of lugs 36, 38. That is, the lateral spacing between lugs 40, 42 and 44, 46 of each pair corresponds to the lateral width of lugs 36, 38, which are identical. Nozzle 22, including skirt 34, is integrally fabricated of flexible resilient material, such as HDPE or other suitable plastic material. Sprayer body 16, including barrel 24 and lugs 36, 38 is integrally fabricated, preferably of less resilient material, such as integrally molded polypropylene or other suitable plastic material. Lug pairs 40, 42 and 44, 46 are positioned on skirt 34 with respect to the outlet opening(s) 48 in nozzle end wall 32 such that the dispensing of liquid through the outlet opening(s) is blocked when nozzle lugs 40–46 embrace barrel lugs 30, 36. At this position of the nozzle illustrated in FIG. 2, simple rotation of the nozzle is blocked by circumferential abutment of the nozzle lugs against opposite sides of the barrel lugs. In order to rotate the nozzle in either direction toward a dispensing position, squeezing forces must be applied to the nozzle skirt at positions spaced about 90° from the lugs. These forces radially outwardly distort the portions of the skirt that carry the lugs so that the nozzle lugs clear lugs 36, 38 on barrel 26, and rotation of the nozzle is permitted. This so-called squeeze-and-turn rotation of the nozzle resists rotation of the nozzle by a child. After dispensing liquid from the container, the nozzle may be simply rotated (with or without squeezing) toward an "off" position. Abutment of nozzle lugs 40–46 with barrel lugs 36, 38 will cam the flexible resilient nozzle skirt radially outwardly until the nozzle lugs snap into position on opposed sides of the barrel lugs, releasably to lock the nozzle in a non-dispensing "off" position.

Nozzle skirt 34 also has a diametrically opposed pair of interior detent recesses 50, 52 that open to the free end of the skirt. Recesses 50, 52 are at 90° spacing from lug pairs 40, 42 and 44, 46. In the "spray" and "stream" dispensing positions of nozzle 22, recesses 50, 52 cooperate with the radially outer ends of lugs 36,38 releasably to hold the nozzle in position. The circumferentially spaced side edges of recesses 50, 52 are at a shallow angle to the circumference to permit easy camming of the side edges over lugs 36,38 when rotating the nozzle from a dispensing position toward an "off" position. Angles of 60° are preferred but exemplary.

Figure 5:
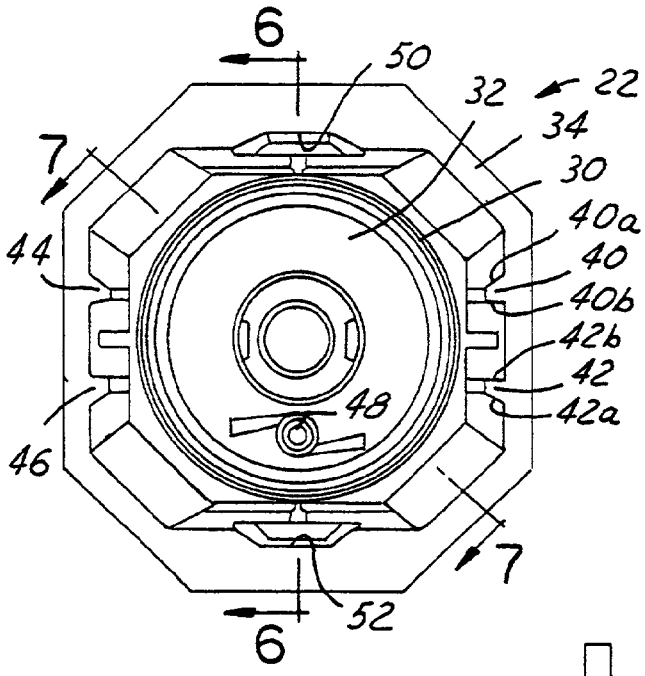
FIG. 5 is an end elevational view of the nozzle of FIG. 4.
Figure 6:
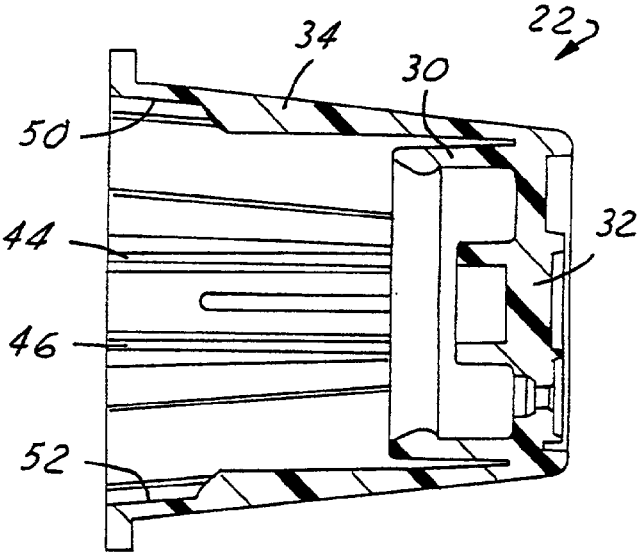
FIGS. 6 and 7 are sectional views taken substantially along the respective lines 6—6 and 7—7 in FIG. 5.
Figure 7:
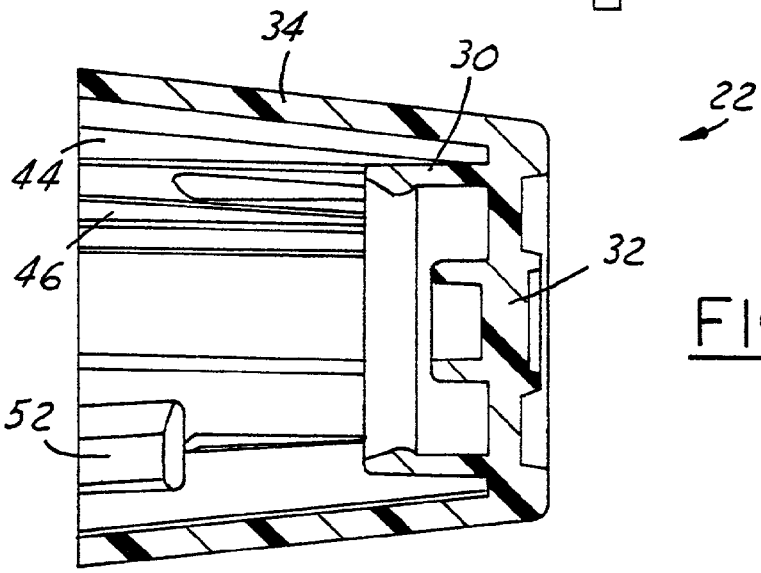

Referring to FIGS. 2–3, barrel lugs 36, 38, in the illustrated exemplary but presently preferred embodiment of the invention, have forward edges in the direction of the barrel outlet that are angled downwardly with respect to the barrel outlet end. The radially outer edges of lugs 36, 38 preferably are angled with respect to the axis of the barrel, most preferably about 4°. The laterally facing side surfaces of lugs 36, 38 are substantially parallel with each other, with only a slight draft angle to facilitate molding. Lugs 40–46 on nozzle skirt 34 preferably are in the form of elongated parallel ribs that taper narrowingly from adjacent to the free edge of the skirt toward end wall 32 of nozzle 22. The inside edges of rib-shaped lugs 40–46 are preferably at an angle of about 4° to the central axis of the angle. Skirt 34 is itself at a preferred angle of about 6° with respect to the central axis of the nozzle, which is preferably coaxial in assembly with the axis of barrel 16 and outlet passage 26. The outside edge surfaces of rib-lugs 40–46—i.e., the edge surfaces of the ribs facing away from the associated rib of each pair, such as surfaces 40*a*, 42*a* in FIG. 5—are angled with respect to the associated flat portion of the nozzle skirt, as best seen in FIG. 5. These angled edge surfaces help cam the lugs over the edges of nozzle lugs 36, 38, and are at an angle of about 30° from the lateral center plane of the nozzle in the illustrated exemplary embodiment of the invention. The inside edge surfaces of rib-lugs 40–46, such as edge surfaces 40*b*, 42*b* in FIG. 5, are at a steeper angle to the nozzle center plane—e.g., about 7°—to prevent camming of the lugs and outward flexure of the closure skirt if it is attempted to rotate the nozzle from an "off" position without squeezing and distorting the nozzle skirt. Thus, when rotating the nozzle from the "spray" position or the "stream" position to an "off" position, rib-lugs 40–46 cam over the opposing edges of barrel lugs 36, 38 and snap around the barrel lugs to lock the nozzle in an "off" position. To rotate the nozzle from the "off" position, the nozzle skirt must be squeezed and distorted as previously described.

Figure 8:
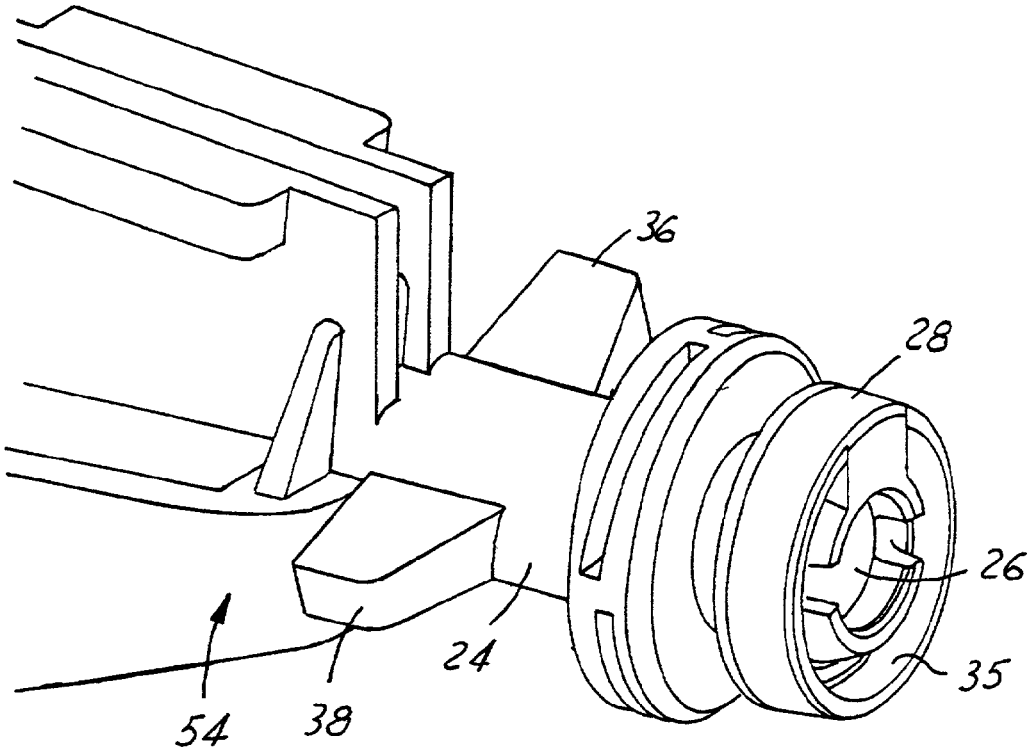
FIG. 8 is a perspective view that is similar to that of FIG. 3 but illustrates a modified sprayer body.
Figure 9:
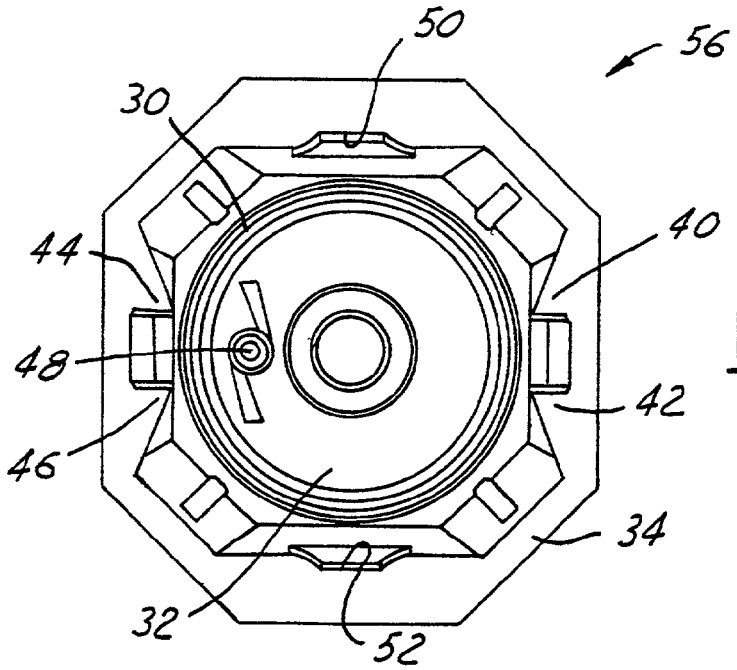
FIG. 9 is a view that is similar to that of FIG. 5 but illustrates a nozzle for the sprayer body of FIG. 8.

FIGS. 8 and 9 illustrate a modified embodiment of the invention. In sprayer body 54 of FIG. 8, lugs 36, 38 extend radially outwardly from the opposed sides of barrel 34, rather than from the top and bottom of the barrel as in FIG. 3. In nozzle 56 of FIG. 9, outlet 48 is on the diameter of lug pairs 40, 42 and 44, 46, rather than at 90° spacing as in FIG. 5. Also in FIG. 9, the outside edge surfaces of rib-lugs 40–46 are at a steeper angle to the diameter, for example 68° in FIG. 9 versus 30° in FIG. 5, and the side edges of recesses 50, 52 are convex rather than planar. Both of these modifications facilitates rotation of the nozzle from a dispensing position toward an "off" position by camming nozzle skirt radially outwardly. However, the nozzle cannot be rotated from an "off" position to a dispensing position without manually squeezing and distorting the nozzle skirt.

There are thus provided a child-resistant trigger sprayer and package that fully satisfy all of the objects and aims previously set forth. The child-resistant trigger sprayer may be readily operated by persons who can understand the squeeze-and-turn concept of the sprayer, while resisting use by persons such as children for whom this concept is not readily understandable. Suitable indicia and/or arrows, such as "Squeeze and Turn" may be provided (such as by molding, printing or labeling) on the upper surface of sprayer body 16 to facilitate use. The child-resistant mechanism is completely internal to the sprayer, which provides an aesthetic advantage as well as reducing likelihood of defeat by a child. The nozzle may be squeezed and rotated to a dispensing position with one hand, while the other user's hand grasps the container. A number of modifications and variations to the preferred embodiment of the invention have been discussed. Other modifications and variations will readily suggest themselves to persons of ordinary skill in the art. The invention is intended to embrace all such modifications and variations as fall within the spirit and broad scope of the appended claims.

The invention claimed is:

1. A child-resistant trigger sprayer that includes:

a sprayer body having a barrel with an internal passage, and at least one first lug formed integrally with said barrel and extending radially outwardly from said barrel, and a nozzle rotatable on said barrel between at least one first position for dispensing liquid from said passage and at least one second position for blocking dispensing of liquid from said passage, said nozzle having a flexible resilient skirt telescopically received over said barrel and said first lug on said barrel, and at least one pair of second lugs having opposed surfaces extending radially inwardly from said skirt for circumferential abutment on opposed sides of said first lug to block rotation of said nozzle in both directions from said second position toward said first position, said skirt being deflectable to distort the portion of said skirt carrying said second lugs radially outwardly so as to be rotatable past said first lug.

2. The sprayer set forth in claim 1 wherein said nozzle includes diametrically opposed pairs of second lugs extending radially inwardly from said skirt releasably to lock said nozzle on said barrel at positions 180° spaced from each other.

3. The sprayer set forth in claim 2 wherein said barrel has diametrically opposed first lugs on said barrel for cooperating with said diametrically opposed pairs of second lugs on said nozzle.

4. The sprayer set forth in claim 1 wherein said barrel has diametrically opposed first lugs on said barrel for cooperating with said second lugs on said skirt releasably to lock said nozzle on said barrel at positions 180° spaced from each other.

5. The sprayer set forth in claim 4 wherein said nozzle includes diametrically opposed pairs of second lugs extending radially inwardly from said skirt releasably to lock said nozzle on said barrel at positions 180° spaced from each other.

6. The sprayer set forth in claim 1 wherein said second lugs have respective outer surfaces spaced from each other and disposed at respective angles to cam said second lugs over said first lug when rotating said nozzle to said second position.

7. The sprayer set forth in claim 6 wherein said second lugs have respective inner surfaces facing each other and disposed at respective angles to resist camming said second lugs over said first lug when attempting to rotate said nozzle away from said second position absent distortion of said nozzle.

8. A child-resistant trigger sprayer that includes:

a sprayer body having a barrel with an internal passage, and at least one first lug formed integrally with said barrel and extending radially outwardly from said barrel, a nozzle rotatable on said barrel between at least one first position for dispensing liquid from said passage and at least one second position for blocking dispensing of liquid from said passage, said nozzle having a flexible resilient skirt telescopically received over said barrel and said first lug on said barrel, and at least one pair of second lugs extending radially inwardly from said skirt for circumferential abutment on opposed sides of said first lug to block rotation of said nozzle in both directions from said second position toward said first position, said skirt being deflectable to distort the portion of said skirt carrying said second lugs radially outwardly so as to be rotatable past said first lug, wherein said skirt has at least one internal detent recess for cooperating with said at least one first lug for releasably holding said nozzle in said first position of said nozzle.

9. A child-resistant trigger sprayer that includes:

a sprayer body having a barrel with an internal passage and a pair of diametrically opposed external lugs spaced from an outlet end of said barrel, and a nozzle mounted for rotation on said barrel between first and second positions 180° spaced from each other for dispensing liquid from said passage, and third and fourth positions 180° spaced from each other and spaced 90° from said first and second positions for blocking dispensing of liquid from said passage, said nozzle having a flexible resilient skirt telescopically received over said barrel and said lugs on said barrel, said skirt having diametrically opposed spaced pairs of internal lugs for circumferential abutment on opposed sides of said lugs on said barrel to block rotation of said nozzle in both directions from said third and fourth positions toward said first and second positions, said skirt being deflectable upon application of external pressure to said skirt to distort said skirt such that said pairs of lugs on said skirt are deflected radially outwardly sufficiently to clear said lugs on said barrel and permit rotation of said nozzle in both directions from said third and fourth positions toward said first and second positions.

10. The sprayer set forth in claim 9 wherein each said pair of lugs have respective outer edge surfaces remote from each other and disposed at respective angles to cam said lugs on said skirt over said barrel when rotating said nozzle to said third and fourth positions.

11. The sprayer set forth in claim 10 wherein each pair of said internal lugs on said skirt comprise spaced parallel ribs.

12. The sprayer set forth in claim 11 wherein said lugs on said barrel have radially outer edges, and said ribs on said nozzle have radially inner edges that are parallel to said outer edges.

13. The sprayer set forth in claim 9 wherein said skirt has diametrically opposed internal detent recesses for receiving said lugs in said first and second positions releasably to hold said nozzle in said first and second positions.

14. A child-resistant trigger sprayer liquid dispensing package that includes:

a container having an open end and a trigger sprayer secured to said open end, said trigger sprayer comprising:

a sprayer body having a barrel with an internal passage, and at least one first lug formed integrally with said barrel and extending radially outwardly from said barrel, and a nozzle rotatable on said barrel between at least one first position for dispensing liquid from said passage and at least one second position for blocking dispensing of liquid from said passage, said nozzle having a flexible resilient skirt telescopically received over said barrel and said first lug on said barrel, and at least on pair of second lugs having opposed surfaces extending radially inwardly from said skirt for circumferential abutment on opposed sides of said first lug to block rotation of said nozzle in both directions from said second position toward said first position, said skirt being deflectable to distort the portion of said skirt carrying said second lugs radially outwardly so as to be rotatable past said first lug.

15. The package set forth in claim 14 wherein said nozzle includes diametrically opposed pairs of second lugs extending radially inwardly from said skirt releasably to lock said nozzle on said barrel at positions 180° spaced from each other.

16. The package set forth in claim 15 wherein said barrel has diametrically opposed first lugs on said barrel for cooperating with said diametrically opposed pairs of second lugs on said nozzle.

17. The package set forth in claim 14 wherein said barrel has diametrically opposed first lugs on said barrel for cooperating with said second lugs on said skirt releasably to lock said nozzle on said barrel at positions 180° spaced from each other.

18. The package set forth in claim 17 wherein said nozzle includes diametrically opposed pairs of second lugs extending radially inwardly from said skirt releasably to lock said nozzle on said barrel at positions 180° spaced from each other.

19. The package set forth in claim 17 wherein said second lugs have respective outer surfaces spaced from each other and disposed at respective angles to cam said lugs over said first lug when rotating said nozzle to said second position.

20. The package set forth in claim 19 wherein said second lugs have respective inner surfaces facing each other and disposed at respective angles to resist camming said second lugs over said first lug when attempting to rotate said nozzle away from said second position absent distortion of said nozzle.

21. The package set forth in claim 18 wherein said skirt has at least one internal detent recess for cooperating with said at least one first lug for releasably holding said nozzle in said first position of said nozzle.

* * * * *